US006122862A

United States Patent [19]

Hörmann

[11] Patent Number: 6,122,862

[45] **Date of Patent: *Sep. 26, 2000**

[54] DOOR WITH A WEIGHT-BALANCING DEVICE WITH HELICAL SPRINGS

[76] Inventor: Thomas J. Hörmann, Am Schlaufenglan 33, 66606 St. Wendel, Germany

[ * ] Notice: This patent is subject to a terminal disclaimer.

[21] Appl. No.: 09/155,531

[22] PCT Filed: Apr. 1, 1997

[86] PCT No.: PCT/DE97/00660

§ 371 Date: Dec. 7, 1998

§ 102(e) Date: Dec. 7, 1998

[87] PCT Pub. No.: WO97/37097

PCT Pub. Date: Oct. 9, 1997

[30] Foreign Application Priority Data

Mar. 29, 1996 [DE] Germany ..... 296 05 912 U
Sep. 13, 1996 [DE] Germany ..... 296 15 973 U

[51] Int. Cl.[7] ..... E05D 15/38

[52] U.S. Cl. ..... 49/197; 49/200; 160/191

[58] Field of Search ..... 49/197, 199, 200; 267/179, 168, 169, 170, 140.12, 290; 160/191, 192

[56] References Cited

U.S. PATENT DOCUMENTS 3,348,336 10/1967 Hashagen ..... 49/200
4,757,853 7/1988 Price ..... 49/197

*Primary Examiner*—Daniel P. Stodola
*Assistant Examiner*—Curtis A. Cohen
*Attorney, Agent, or Firm*—Max Fogiel

[57] ABSTRACT

An overhead garage door arrangement in which a door leaf is moveable between open and closed position, and is installable against a ceiling for sliding up and down or that can be tilted or swung up and down for compensating against the weight of the door, at least one helical spring module is provided with a least two parallel-loaded helical tension springs that are arranged coaxially one within the other, and that are wound in opposite directions. The inner spring has an outside diameter which is smaller than the inside diameter of the outer spring. The oppositely wound coils of the coaxial springs cross each other. The two springs are pushed over a holding element which has a narrower first section for receiving the inner spring, and having a wider second section spaced from the first section for receiving the outer spring. The first and second sections of the holding element have edges with hook-shaped portions for grasping coils of the coaxial springs.

8 Claims, 11 Drawing Sheets

DOOR WITH A WEIGHT-BALANCING DEVICE WITH HELICAL SPRINGS

BACKGROUND OF THE INVENTION

The present invention concerns a door that can be opened and closed by raising and lowering it vertically, that can be installed against a ceiling and slide up and down on rollers, or that can be tilted or swung up and down. It features a weight-compensation mechanism attached to it at one end and to a fixed point at the other and including one or more helical-spring modules.

Equipping overhead doors with weight-compensation means to maintain the forces need to open and close them weak is known. Such means include "torsion" springs that apply forces to the door by means of cords and weight-compensation shafts and helical springs, both tension and compression.

When helical springs are involved, means of preventing broken sections from flinging out are necessary. Such means can be tubes that telescope in the event of breakage and devices that extend within the spring and intercept the fragments.

The diameter of the tubes must be longer, the longer the diameter of the spring, which depends in turn on its performance curve in that springs intended to accommodate more powerful forces must be wider than those intended to accommodate weaker ones.

Several weak helical tension springs have been paralleled as an alternative to a single more powerful spring. In this approach, however, each individual spring must be provided with a safety-ensuring device of its own extending through it.

The advantage of several parallel springs is that, if a spring breaks, the forces acting on the door will not all be eliminated. Still, a module comprising several springs of specific power or storage capacity will occupy considerable space.

SUMMARY OF THE INVENTION

The present invention is intended to reduce the space needed to accommodate such helical-spring modules.

This object is attained in accordance with the present invention in that the helical-spring module or modules includes or include at least two parallel-loaded coaxial or nested helical springs, whereby the outside diameter of the coil of the inner spring is shorter than the inside diameter of the coil of the outer spring and whereby the coil of one of the springs in a module winds to the left and the coil in the other winds to the right, the two coils crossing each other.

The coaxial arrangement of the two or more springs allows an overall performance curve with a high storage capacity, even in comparison with those of similar larger and more powerful spring or of several adjacent weaker springs, in little space. The mutual proximity of the coaxial or nested springs is particular important and is possible only because of the opposed winding with the coil of one spring crossing that of the other. The springs can accordingly be very close to each other without the coil of one spring engaging the gaps between the coil in the other spring and jamming it.

Each inner spring intercepts any fragments broken off the outer spring and each outer spring constitutes a cylinder surrounding the inner spring, preventing such fragments from flinging out.

When such coaxial tension springs of different diameter are mounted horizontal, they will also prevent each other from sagging. Compression springs on the other hand will help to prevent each other from buckling horizontally, and this function can be augmented with a guide in the form of a tube surrounding them or of a rod extending through them.

The surfaces of the coils that come into contact are protected from friction in one preferred embodiment by a slick intermediate layer, preferably a sleeve of low-friction plastic.

When helical compression springs are employed, they are conventionally secured at the ends. When helical tension springs are employed, their coils can basically be provided with hooks at their ends at an angle to their winding. One preferred embodiment also employs flat-ended helical tension springs thrust over accommodations as disclosed in Europe Patent 0 266 061 B1 and German 3 924 947 C2.

Tension-spring modules of the type illustrated herein at one end of a spring are employed with ceiling-mounted doors paralleling the horizontal sections of track and especially at the outer sides. The ends of the springs remote from the door can be fixed and the other ends provided with pulleys secured in bearings comprising cheeks 35 and 36. The pulleys in turn accommodate the cords that transmit to the door the forces exerted by the springs. Additional security is provided by using two parallel cords that extend around grooves in the circumference of the pulleys and into adjacent holders at their ends. The cords can be secured to the track at one end by rockers to distribute the load to both cords equally.

A force-per-extent performance curve that is staggered over both the expansion and compression sections can be achieved if, instead of actuating all the springs at once, one spring is secured through appropriate distancing of its engagement or support while the helical-spring module is unloaded or relieved and engages only during extension or compression of the module subsequent to a certain initial distance.

BRIEF DESCRIPTION OF THE DRAWINGS

Preferred embodiments of the present invention are recited in the subsidiary claims and will now be specified with reference to the accompanying drawing, wherein

DESCRIPTION OF THE PREFERRED EMBODIMENTS

Figure 1:
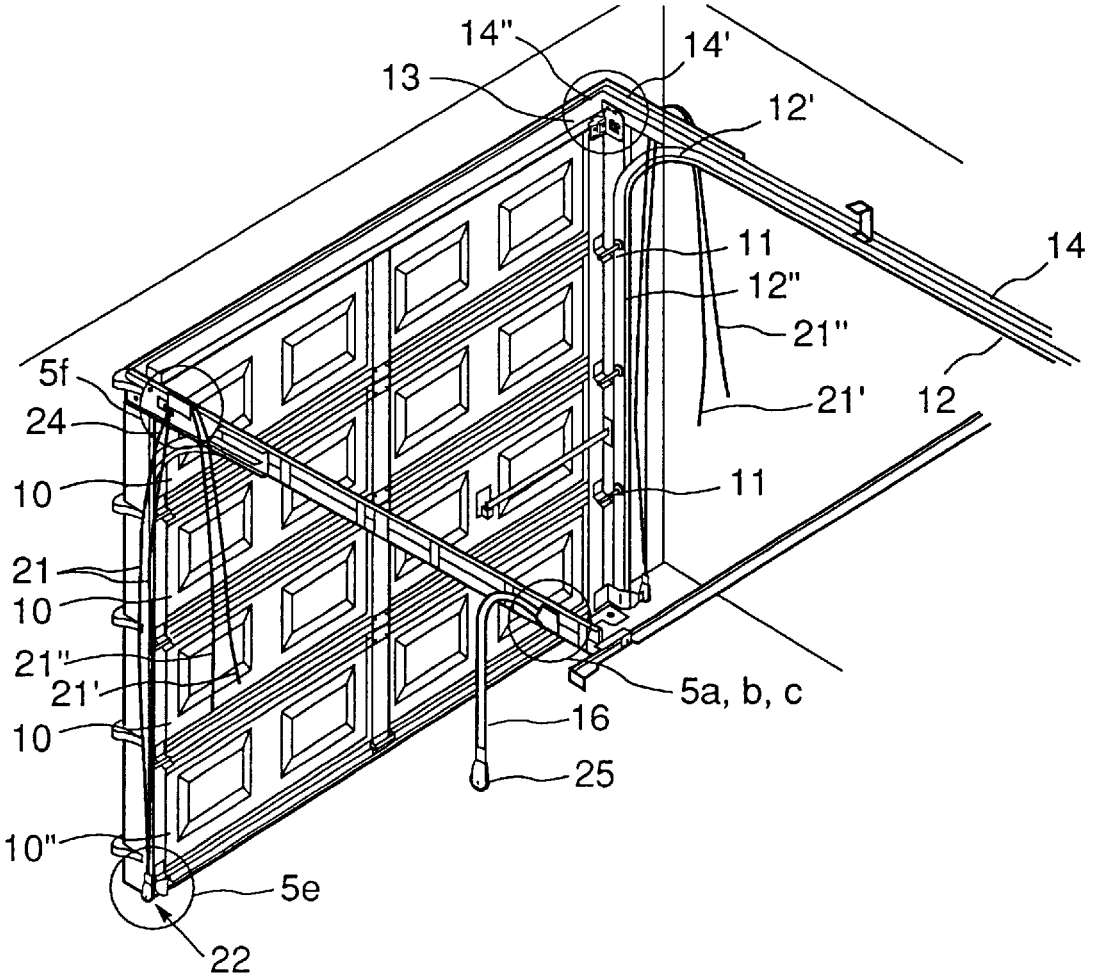
FIG. 1 is a perspective view of the back of a ceiling-mounted door along with its tracks, the weight-compensation mechanism being incompletely illustrated, FIGS. 2*a* and 2*b* comprises side view embodiments as seen from the door and a top view of the horizontal and sloping and curved sections of track.

The ceiling-mounted door schematic illustrated in FIG. 1 is composed of a series of panels 10. The panel 10' that is uppermost and the panel 10" that is lowermost when the door is closed differ from the rest of the panels. Aside from uppermost door panel 10', all the panels are conventionally supported by rollers 11 that travel in a set of tracks at each edge of the door. Each track comprises a horizontal section 12, a curved section 12', and a vertical section 12". Uppermost door panel 10' is supported at its upper edge 13 by rollers 11 that travel in another set of tracks at each side of the door. The tracks in the second set comprises a horizontal section 14, a section 14' that slopes down toward the doorway, and a bent-down section 14".

Such an embodiment is in-itself known. The illustrated door is provided with an in-itself basically known weight-compensation mechanism 15 comprising helical tension springs and associated cords. In this particular embodiment, a single spring parallels each horizontal section of track. The spring is secured to the wall of the building and, toward the door, to a deflection pulley. A cord extends around each pulley and is attached at one end to the lower edge of the uppermost panel and at the other to a fixed point, specifically to a component of the doorcase. The illustrated embodiment has a tension-spring system against each outward-facing side of horizontal sections 12 and 14, and accordingly occupies practically no space above or below the tracks. Very little space is occupied at each side because the helical tension-spring systems comprise several parallel helical-spring modules 16, the number depending on how heavy the door is and on the risk of breakage. Each spring module in turn comprises two coaxial or nested individual helical tension springs, with the coils of inner spring 17 winding opposite those of its associated outer spring 18 and along the same axis. Viewed at a right angle to that axis accordingly, the coils of each spring cross those of the other spring at an acute angle, as will be particularly evident from FIGS. 3*a* to 3*c* and 4*a* and 4*b*.

Each helical-spring mechanism, comprising one or more parallel helical-spring modules 16 per horizontal track section, is, as will be evident from FIGS. 5*a* to 5*f*, fastened to the wall of the building, specifically at the end of horizontal sections 12 and 14 remote from the doorway. Where they join each other at the doorway, the sections are provided with a pair of deflection pulleys 25 or with a single deflection pulley 25 with two parallel grooves around it. Cords 21 wrap around each pulley and, extending parallel to each other, are secured at the ends to practically similar structures, specifically to a common in-itself known stationary attachment 22 at the lower edge 23 of lowermost door panel 10" and at the end nearer the doorway of horizontal sections 12 and 14. The cords wrap around a direction-reversing pulley 24 between deflection pulleys 25 and stationary attachment 22 to match the change in position of the stationary attachment as the door moves to the stationary axis of the spring modules.

Figure 2A:
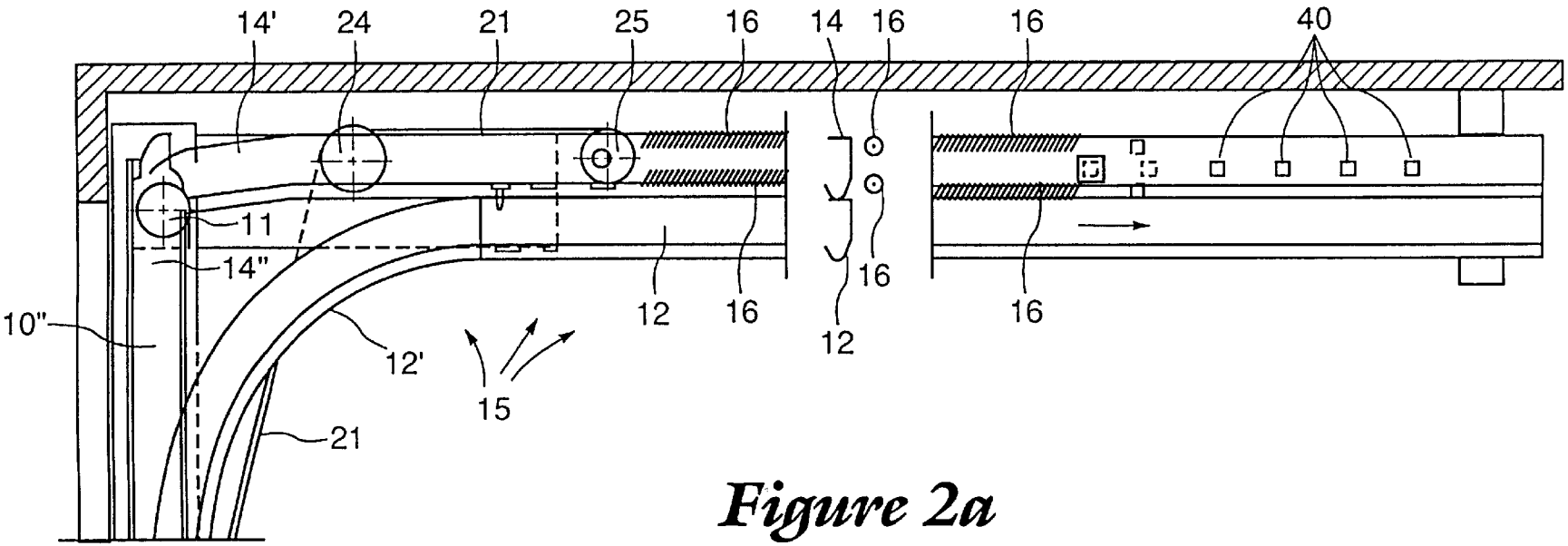
Figure 2B:
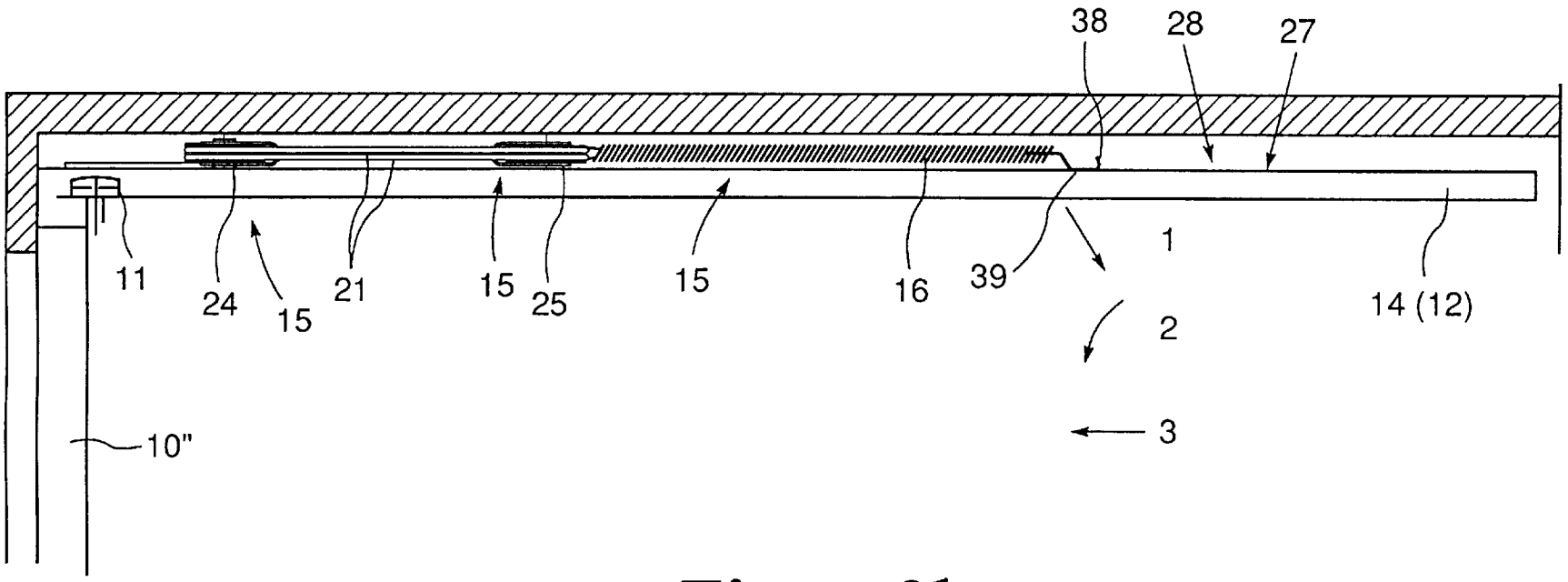

FIGS. 2*a* and 2*b* schematically illustrate how helical-spring modules 16 relate to the horizontal sections 12 and 14 of track. An edge-on view is schematically interposed at the middle of the side view in FIG. 2*a*. It will be evident that each spring module comprises two coaxial helical springs with oppositely winding coils. The figure also illustrates how the two parallel cords associated with each spring mechanism are distributed. Particularly evident is the structure and relative position of horizontal section 14 and weight-compensation mechanism 15. Weight-compensation mechanism 15 comprises two helical-spring modules 16, one above the other. The edge-on view is a section through the two tracks. The side views in FIGS. 2*a* and 2*b* illustrate a row 40 of holes punched out of the end of the horizontal section 14 of the second set of tracks extending into the building. These holes are engaged by anchors 37 attached to the ends of helical-spring modules 16 that extend into the building as will be specified hereinafter with reference to FIGS. 5*a* to 5*f*.

Figure 3A:
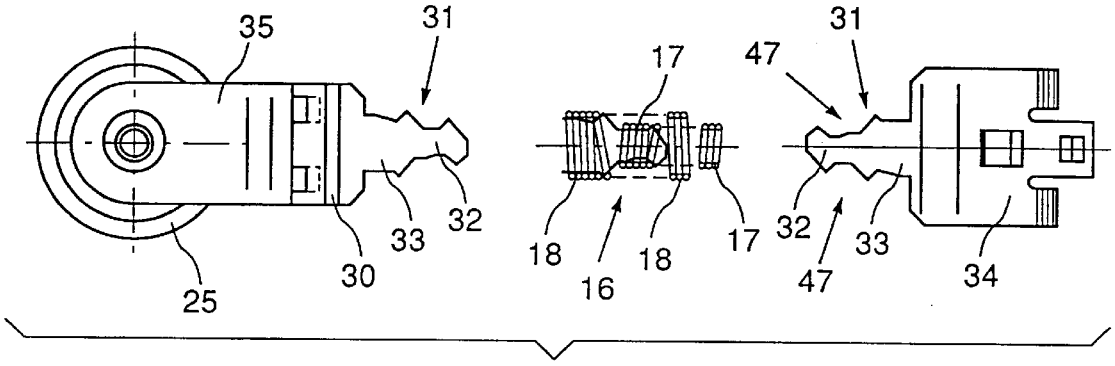
FIGS. 3*a* to 3*e* illustrate various versions of one or more parallel spring modules, each comprising two coaxial springs, along with a schematic details of the springs.
Figure 3B:
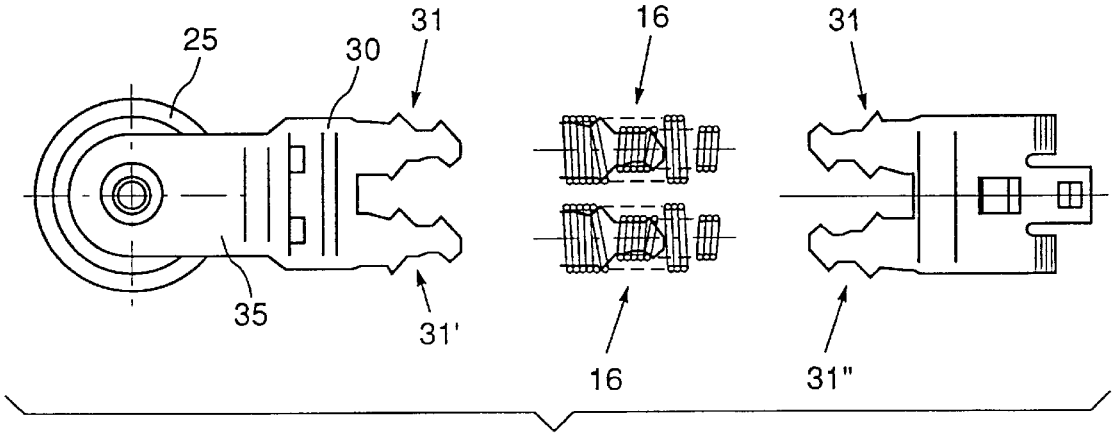
Figure 3C:
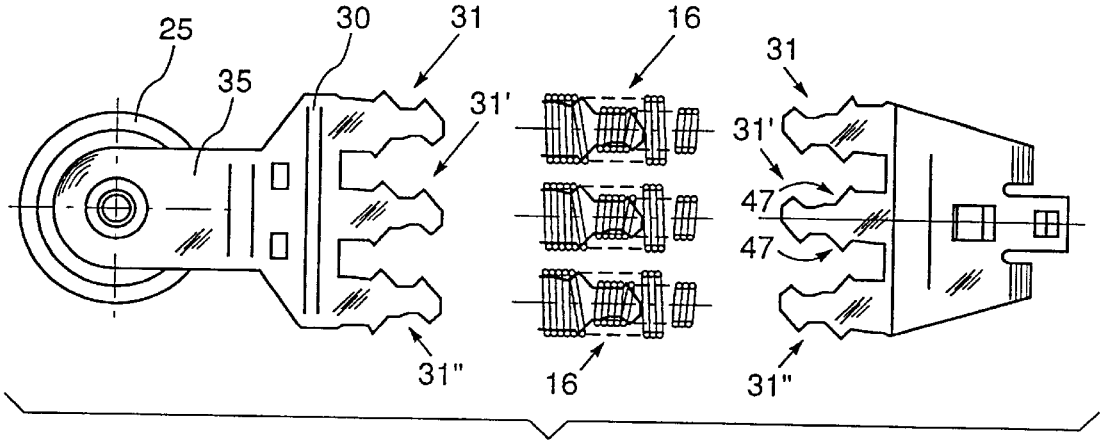
Figure 3D:
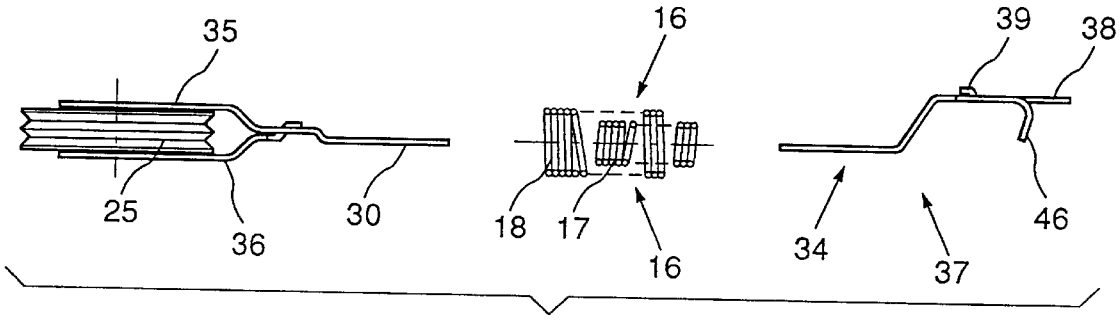

FIGS. 3*a* to 3*c* are "exploded" views of three versions of the helical-spring mechanisms attached to the sides of horizontal sections 12 and 14. The first version (FIG. 3*a*) includes a single spring module 16, the second (FIG. 3*b*) two, and the third (FIG. 3*c*) three parallel modules 16. Each module comprises two coaxial springs 17 and 18, represented abbreviated at the middle. At the ends of each module are connectors 30, associated with pulley bearings 35 & 36 and anchors 37. Anchors 37 are provided with tabs 38 and 39, one for each tongue 31, 31', and 31" in a spring module 16. Below the side views is a top view. How the springs in each spring module are attached will be specified hereinafter with reference to FIGS. 4*a* and 4*b*.

Figure 3E:
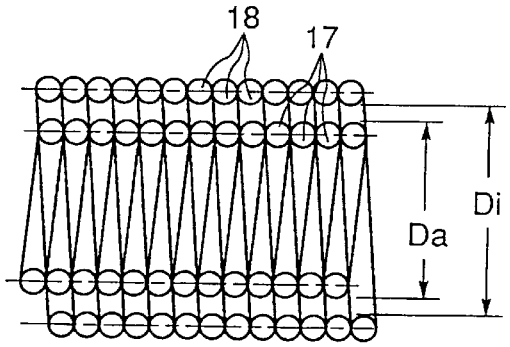

Illustrated in FIG. 3*e* is part of a spring module comprising two coaxial springs, specifically an inner spring 17 enclosed within an outer spring 18. The coils 20 of inner spring 17 wind along the springs' axis 29 opposite those of outer spring 18 and accordingly cross them at an acute angle. The outside diameter Da of inner spring 17 is shorter than the inside diameter of outer spring 18. The springs can accordingly move independently of one another without the windings of one coming between those of the other, even though the difference between diameters Di and Da is small. Material can be inserted between the springs to decrease friction between the proximate surfaces of coils 20. Each individual coil wire can for example be accommodated in a Ü-shaped sleeve or the coil as a whole in a cylindrical sleeve of low-friction plastic.

Figure 4A:
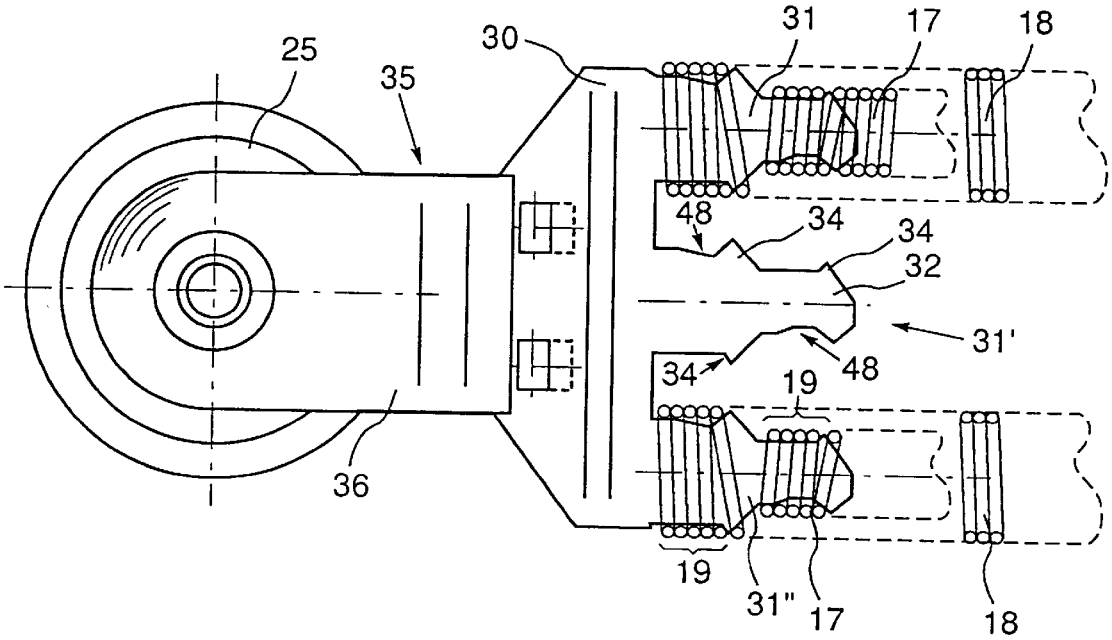
FIGS. 4*a* and 4*b* comprise respectively a larger-scale detail of part of the embodiments illustrated in FIG. 3*c* and a partly sectional top view thereof, FIGS. 5*a* to 5*f* comprise larger-scale perspective views of various components of the mechanisms illustrated in FIG. 1.
Figure 4B:
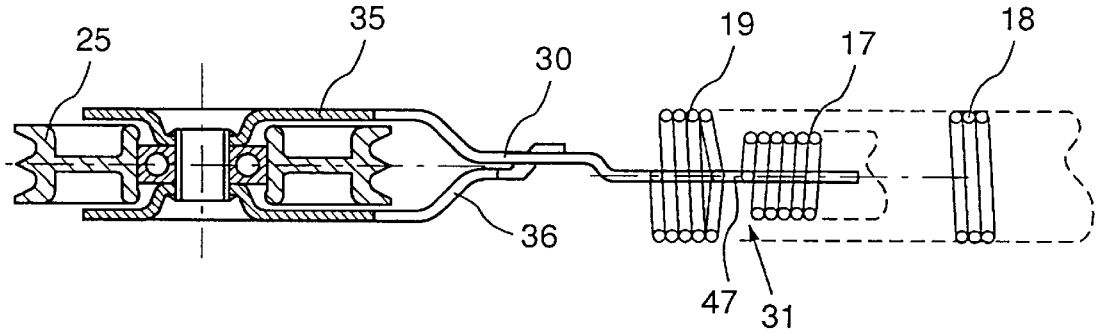

FIGS. 4*a* and 4*b* illustrate how the end with the pair of deflection pulleys 25 of a helical tension-spring system comprising three helical-spring modules 16 is attached to the springs by a flat overall connector 30. Connector 30 is provided with three tongues 31, 31', 31" that project out toward the spring modules. The tongues are all in the same plane, and each comprises a narrower section 32 at the end and a wider section 33 between the narrower section and connector 30. As will be evident from both the side view and the top view in FIG. 4, the outer spring 18 in every helical-spring module 16, the spring with the longer diameter, is thrust over a wider section 33 and toward connector 30 until barbs 34 on the edge 47 of that section engage the coil at the facing end 19 of the spring, maintaining the tongue inside the spring. Inner spring 17, the spring with the shorter diameter, is similarly secured by the barbs associated with narrower section 32. The barbs 34 and depressions 48 along the opposite edges of narrower section 32 and wider section 33 are displaced along the lengths of the sections to fit the opposing windings of springs 17 and 18.

At the end of connector 30 facing away from tongues 31, 31' and 31" is a pair of cord-deflection pulleys 25 accommodated in a bearing comprising two cheeks 35 and 36. Cheek 35 is in one piece with connector 30 and cheek 36 fastened thereto by a hollow rivet that also comprises the axis of rotation for pulleys 25.

Figure 5B:
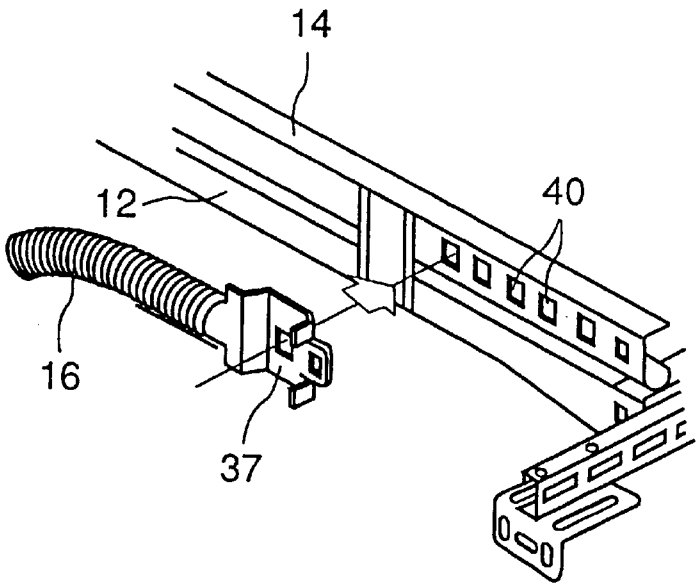
Figure 5A:
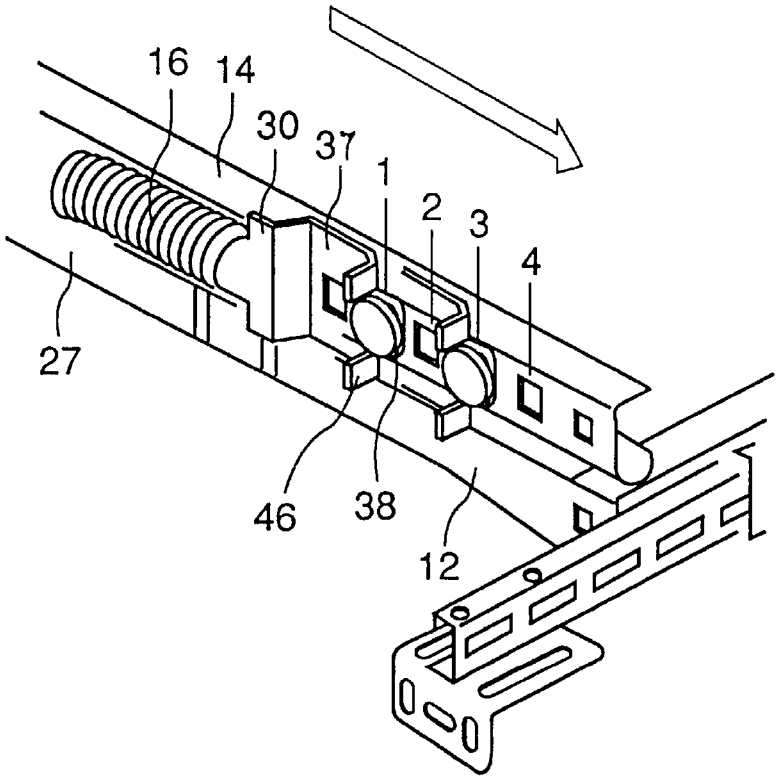
Figure 5D:
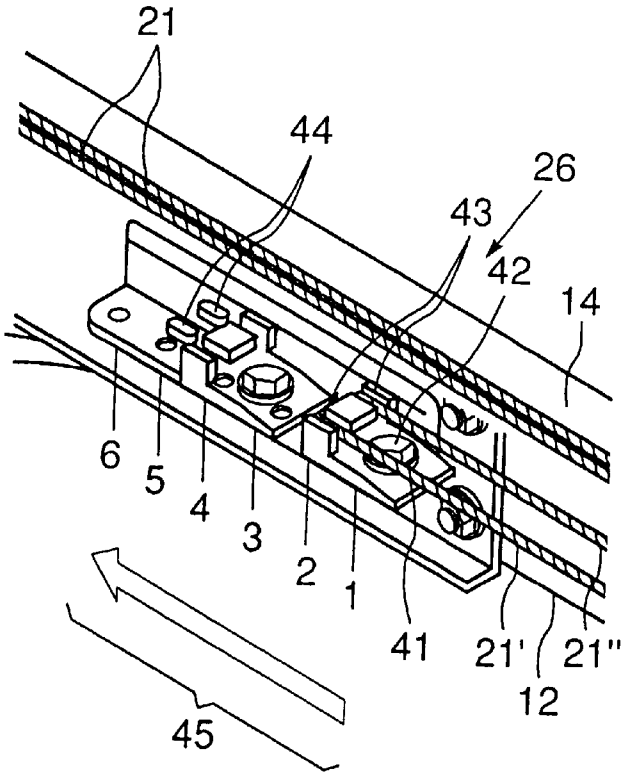
Figure 5C:
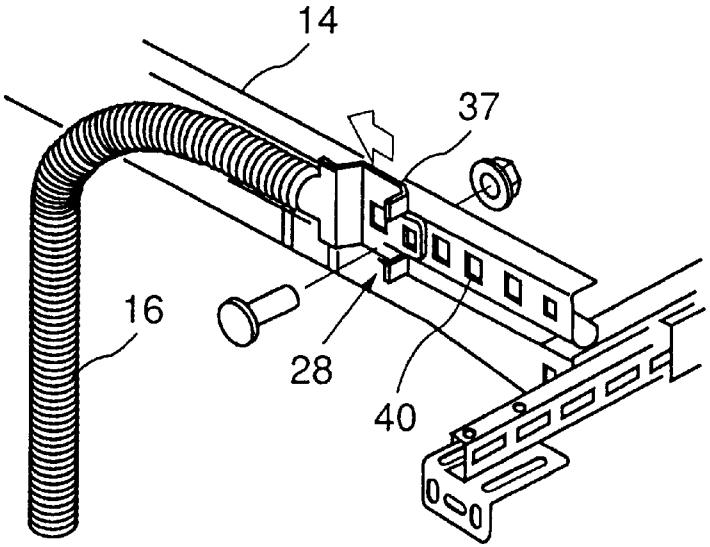

FIGS. 5*a* to 5*f* are a series of larger-scale perspective views of details of FIG. 1. FIGS. 5*a* to 5*f* illustrate how a helical tension-spring system comprising one helical-spring module 16 or a stack of parallel helical-spring modules 16 but represented schematically by a single spring can be fastened at various points to the wall of the building by the anchor 37 illustrated in FIGS. 3*a* to 3*e*. Anchor 37 is inserted in one of the holes in a row 40 punched out of the horizontal section 14 of the second set of tracks. Anchor 37 can be manipulated by finger grips 46. A tab 39 extending at an angle to the springs engages the other side of the section subject to the tension exerted by the springs. Another tab 38 extending opposite tab 39 is provided with a bore that arrives in alignment with the punched-out hole once tab 30 is in place. A bolt is then inserted-through the hole and through the bore to secure the assembly as illustrated in FIGS. 5*a*, 5*b*, and 5*c*.

FIG. 5*d* illustrates how the two parallel cords 21 associated with each edge of the door are secured at the doorway. Each cord 21 has a thicker end 44 accommodated, preferably like that of a Bowden cable, in a suspension structure 43 and secured there by the force exerted by the spring module on its associated deflection pulley 25. Each suspension structure 43 is mounted on a rocker 41 that pivots around an axis 42 to compensate for the difference in the lengths of the cords and distribute the loads equally. To augment the compensation, the suspension structures 43 on each side of axis 42 are farther from deflection pulleys 25 than the axis itself. Rocker 41 can be inserted in any opening in a row 45 extending along horizontal section 14 to vary the length of the stationary assembly, which can accordingly be adapted to the forces of the particular spring forces, to the lengths of the cords, and to age-dictated changes thereof.

Figure 5F:
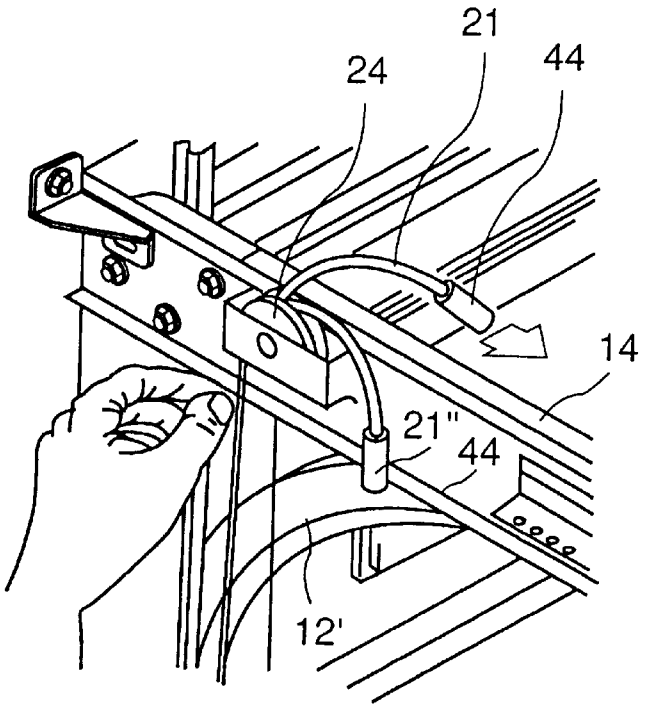
Figure 5E:
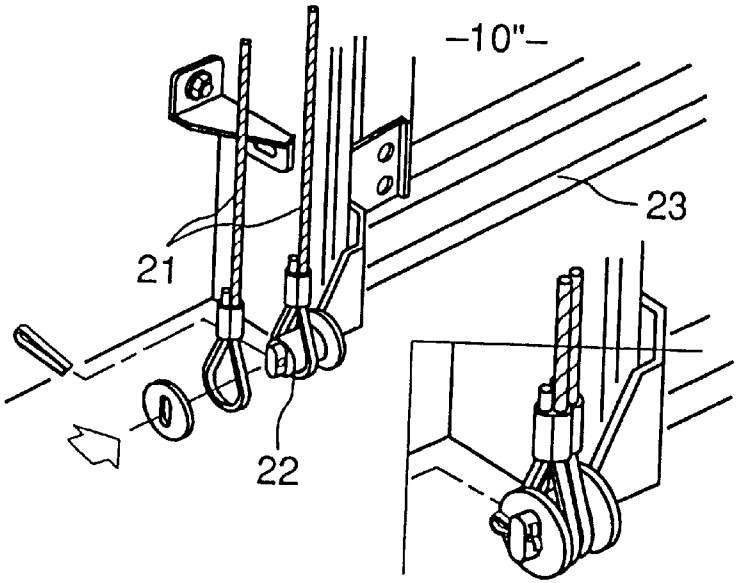

FIG. 5*e* illustrates how the looped other ends of cords 21 are fastened to an attachment 22 at the lower edge 23 of lowermost door panel 10". FIG. 5*f* illustrates a direction-reversing pulley 24 mounted on the side of the horizontal section 14 or of the sloping section 14' of the second set of tracks facing the wall of the building.

Figure 6:
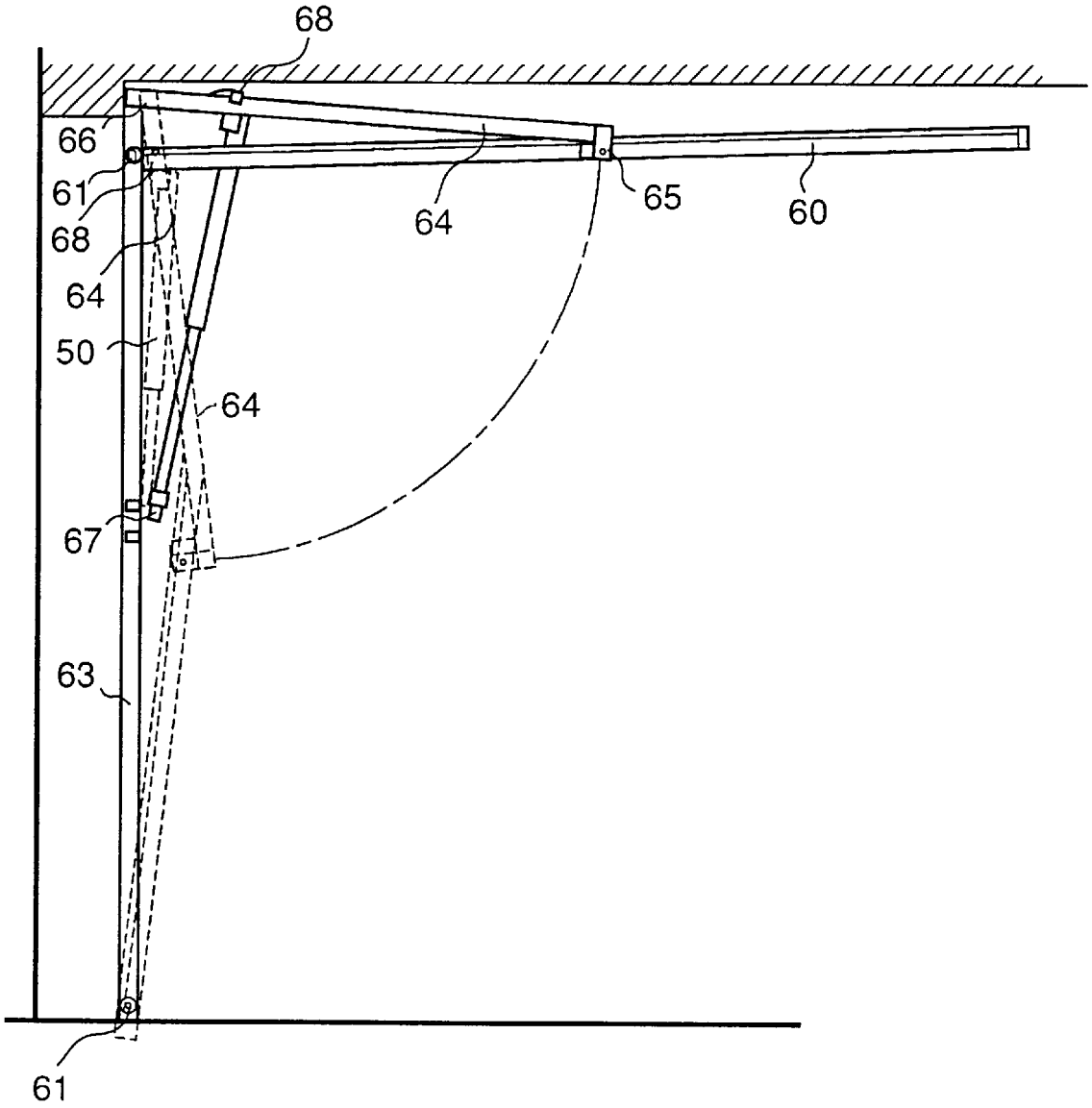
FIG. 6 is a schematic side view of a one-piece tilting door with a weight-compensation mechanism in the form of helical compression-spring modules on each side.

FIG. 6 is a side view from the inside of a system for manipulating a door 60 supported on rollers 61 traveling in vertical tracks 63, at the edges of the doorway and displaced by a pair of tie rods 64 articulated at one end to points 65 more or less halfway up the edge of the door and at the other end to points 66 at the top of tracks 63. Each tie rod 64 is engaged by a helical compression-spring module 50 secured at one end to a point 67 of articulation approximately halfway up track 63 and at the other at a point 68 of articulation at the section of tie rods 64 remote from the stationary attachment. When door 60 is closed, rollers 61 travel down along tracks 63, shortening compression-spring modules 50 and compressing their springs 51 and 52.

Figure 7A:
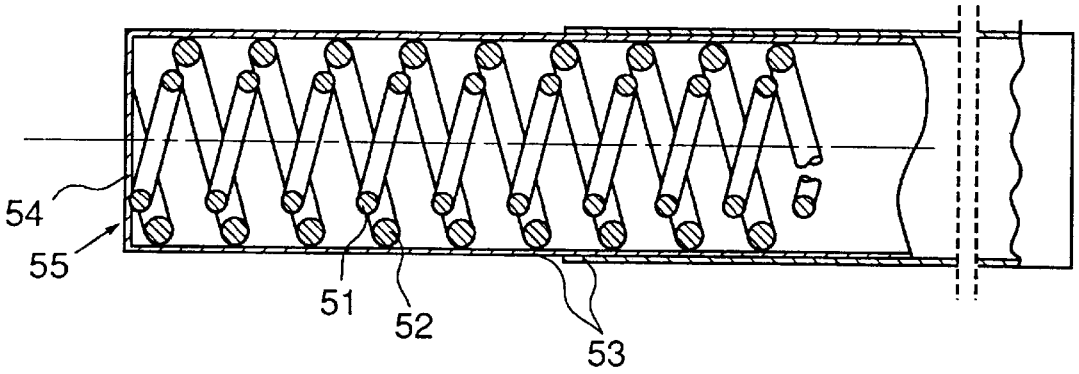
FIGS. 7*a* and 7*c* illustrate embodiments of helical-spring modules comprising compression springs.
Figure 7B:
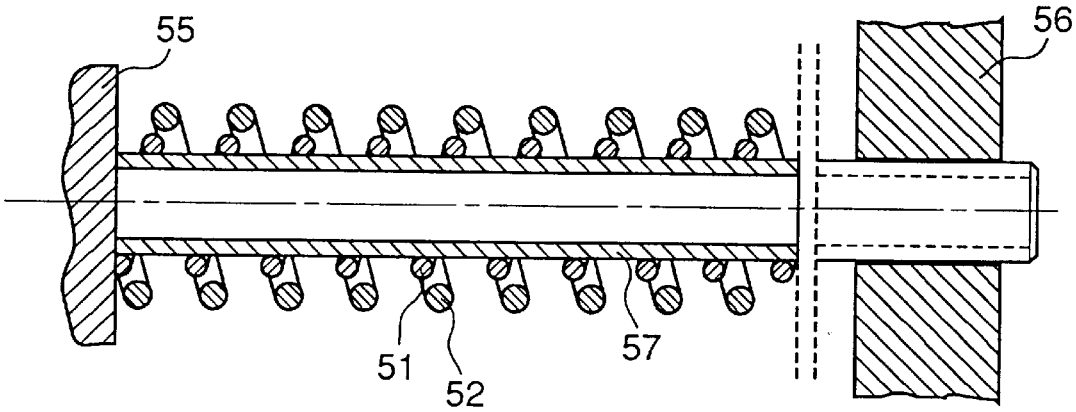
Figure 7C:
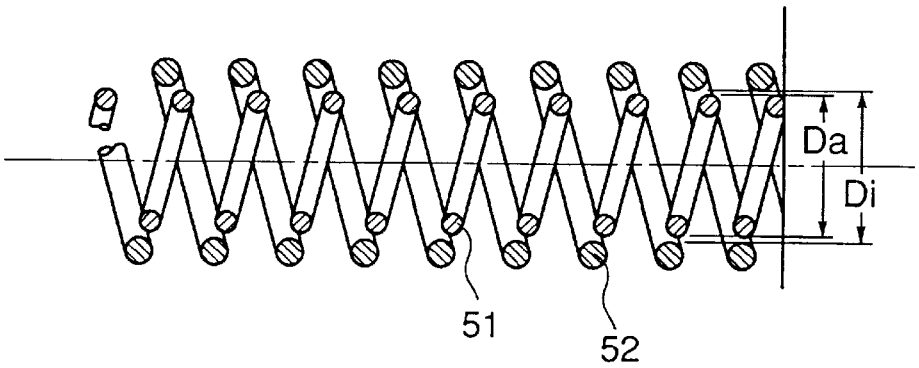

FIGS. 7*a* to 7*c* are a series of lateral sections through the helical compression-spring module 50 illustrated in FIG. 6. Its inner spring 51 is coaxial with its outer spring 52 at enough of a gap to allow the two springs to move independently of each other, meaning that the outside diameter Da of inner spring 51 is somewhat shorter than the inside diameter Di of outer spring 52, as will be particular evident from FIG. 7*c*. The springs can be supported on the supports 55 illustrated on the right in FIGS. 7*a* and 7*c*. The support 55 in FIG. 7*a* is constituted by the base 54 of a telescoping tube 53.

The ends of springs 51 and 52 and the end of the inner section of the telescoping tube on the left in FIG. 7*a* are illustrated broken. The outer section of the tube is illustrated abbreviated and only partly in section. Springs 51 and 52 can move relative to one another as the tube is compressed and extended, the opposed winding of their coils preventing them from interfering with each other. Telescoping tube 53 correctly orients the resulting module 50 for operation.

A one-piece tube can be employed instead of a telescoping tube. Such a tube is provided with longitudinal slots accommodating a support for the right ends of springs 51 and 52, allowing the tube to slide out over the right-end support to the extent of the length of the slot when the springs are compressed.

FIG. 7*b* illustrates another version of a helical compression-spring module 50 with springs 51 and 52, whereby a hollow guide rod 57 extends through inner spring 51 with its left-hand end attached to a support 55 and its right-hand end sliding into and out of a bore in another support 56. When the two supports compress the module, the right-hand end of rod 57 will emerge part-way out of the bore. The emerging section of guide rod 57 can be protected by an unillustrated cap.

List of Parts

10: regular door panel
10': uppermost door panel
10": lowermost door panel
11: roller
12: horizontal section, first set of tracks
12': curved section, first set of tracks
12": vertical section, first set of tracks
13: upper edge of uppermost panel
14: horizontal section, second set of tracks
14': sloping section, second set of tracks
14": bent-down section, second set of tracks
15: weight-compensation mechanism
16: helical-spring module
17: inner spring
18: outer spring
19: spring end
20: coil
21: cord
22: cord attachment
23: lower edge of uppermost panel
24: direction-reversing pulley
25: cord-deflection pulley
26: stationary cord holder
27: sides of horizontal track sections
28: building-wall spring-module attachment
29: spring axis
30: connector
31, 31', 31": tongues
32: narrower tongue section
33: wider tongue section
34: barb
35: pulley bearing cheek
36: pulley-bearing cheek
37: anchor
38: longer tab
39: shorter tab
40: row of holes
41: rocker
42: axis
43: stabilizing or suspension structures
44: thicker cord ends
45: row of openings
46: fingergrip
47: edge
48: depressions
50: helical compression-spring module
51: inner spring
52: outer spring
53: tube
54: base of the telescoping tube
55: support
56: support

57: rod
60: door
61: rollers
63: track
64: tie rods
65: point of articulation
66: point of articulation
67: point of articulation
68: point of articulation
Di: inside coil diameter
Da: outside coil diameter

What is claimed is:

1. An overhead door arrangement with a door leaf moveable between open and closed positions and installable against a ceiling, said door leaf being slidable or pivotable; said arrangement further comprising: weight compensation means having one end connected to said door leaf and another end connected to a fixed point; said weight compensation means comprising at least one helical spring module having at least two parallel-loaded helical tension springs storing a load through elastic deformation and arranged coaxially one within the other to form an inner spring with coils and an outer spring with coils, said inner spring having a smaller coil outside diameter than the coil inside diameter of said outer spring; one of said coaxial springs having coils wound in a first direction and the other of said coaxial springs having coils wound in a second direction opposite to said first direction, said oppositely wound coils of said coaxial springs crossing each other; a holding element, said two springs being pushed over said holding element and having at least one common end, said holding element having a narrower first section facing said coaxial springs for receiving said inner spring, said holding element having also a wider second section spaced from said first section and farther from said inner spring for receiving said outer spring; said first section and said second section of said holding element have edges and barbs with hook-shaped portions on said edges for grasping coils of said coaxial springs pushed over said holding element; a common connector support for carrying as many holding elements as the number of spring modules, said coils wound in opposite directions preventing the coils of said inner spring and said outer spring from hooking into one another for reducing spacing between said inner spring and said outer spring.

2. An overhead door as defined in claim 1, wherein said springs have low-friction coil surfaces.

3. An overhead door as defined in claim 2, including a plastic coating on said coils of said springs.

4. An overhead door as defined in claim 1, wherein said holding element has a region facing away from said first section and said second section of said holding element in form of a roller support for a deflection roller.

5. An overhead door as defined in claim 1, wherein said holding element has a region facing away from said first section and said second section of said holding element in form of an anchor for securing an associated track.

6. An overhead door as defined in claim 1, wherein said helical spring module has springs actuated over different expansion lengths.

7. An overhead door arrangement with a door leaf moveable between open and closed positions and installable against a ceiling, said door leaf being slidable or pivotable; said arrangement further comprising: weight compensation means having one end connected to said door leaf and another end connected to a fixed point; said weight compensation means comprising at least one helical spring module having at least two parallel-loaded helical tension springs storing a load through elastic deformation and arranged coaxially one within the other to form an inner spring with coils and an outer spring with coils, said inner spring hav ing a smaller coil outside diameter than the coil inside diameter of said outer spring; one of said coaxial springs having coils wound in a first direction and the other of said coaxial springs having coils wound in a second direction opposite to said first direction, said oppositely wound coils of said coaxial springs crossing each other; a holding element, said two springs being pushed over said holding element and having at least one common end, said holding element having a narrower first section facing said coaxial springs for receiving said inner spring, said holding element having also a wider second section spaced from said first section and farther from said inner spring for receiving said outer spring; said first section and said second section of said holding element have edges and barbs with hook-shaped portions on said edges for grasping coils of said coaxial springs pushed over said holding element; a common connector support for carrying as many holding elements as the number of spring modules, said coils wound in opposite directions preventing the coils of said inner spring and said outer spring from hooking into one another for reducing spacing between said inner spring and said outer spring; said springs having low-friction coil surfaces; a plastic coating on said coils of said springs; said holding element having a region facing away from said first section and said second section of said holding element in form of a roller support for a deflection roller; said helical spring module having springs actuated over different expansion lengths.

8. An overhead door arrangement with a door leaf moveable between open and closed positions and installable against a ceiling, said door leaf being slidable or pivotable; said arrangement further comprising: weight compensation means having one end connected to said door leaf and another end connected to a fixed point; said weight compensation means comprising at least one helical spring module having at least two parallel-loaded helical tension springs storing a load through elastic deformation and arranged coaxially one within the other to form an inner spring with coils and an outer spring with coils, said inner spring having a smaller coil outside diameter than the coil inside diameter of said outer spring; one of said coaxial springs having coils wound in a first direction and the other of said coaxial springs having coils wound in a second direction opposite to said first direction, said oppositely wound coils of said coaxial springs crossing each other; a holding element, said two springs being pushed over said holding element and having at least one common end, said holding element having a narrower first section facing said coaxial springs for receiving said inner spring, said holding element having also a wider second section spaced from said first section and farther from said inner spring for receiving said outer spring; said first section and said second section of said holding element have edges and barbs with hook-shaped portions on said edges for grasping coils of said coaxial springs pushed over said holding element; a common connector support for carrying as many holding elements as the number of spring modules, said coils wound in opposite directions preventing the coils of said inner spring and said outer spring from hooking into one another for reducing spacing between said inner spring and said outer spring; connector means facing away from tongues at one end of said springs; cheeks on said connector means and comprising a bearing for deflection pulleys; said connector means having an anchor for attachment to an associated track section.

* * * * *